US007625025B1

(12) United States Patent
Zahedi

(10) Patent No.: US 7,625,025 B1
(45) Date of Patent: Dec. 1, 2009

(54) METHOD AND APPARATUS FOR PICKING UP PET EXCREMENT FROM THE GROUND

(76) Inventor: Bijan Zahedi, 1235 Grand Ave., Piedmont, CA (US) 94610

( * ) Notice: Subject to any disclaimer, the term of this patent is extended or adjusted under 35 U.S.C. 154(b) by 0 days.

(21) Appl. No.: 11/904,688

(22) Filed: Sep. 28, 2007

(51) Int. Cl.
*A01K 29/00* (2006.01)

(52) U.S. Cl. ..... 294/1.3

(58) Field of Classification Search ..... 294/1.3, 294/1.4, 1.5, 100
See application file for complete search history.

(56) References Cited

U.S. PATENT DOCUMENTS

| | | | | |
|---|---|---|---|---|
| 1,350,123 | A * | 8/1920 | Theodore | 294/100 |
| 2,212,013 | A * | 8/1940 | Devareaux | 294/100 |
| 2,594,908 | A * | 4/1952 | Gaulke et al. | 294/100 |
| 4,225,169 | A | 9/1980 | DeToma | |
| 4,819,977 | A * | 4/1989 | Cooper | 294/1.4 |
| 4,995,661 | A | 2/1991 | Aurness et al. | |
| 5,335,952 | A | 8/1994 | Clapper | |
| 6,196,601 | B1 | 3/2001 | Juntunen, Jr. | |
| 6,305,322 | B1 | 10/2001 | Patel | |
| 7,281,740 | B1 * | 10/2007 | Fields | 294/100 |
| 2004/0135386 | A1 | 7/2004 | Pineda | |

FOREIGN PATENT DOCUMENTS

| | | | |
|---|---|---|---|
| GB | 2168596 | A | 5/1986 |

* cited by examiner

*Primary Examiner*—Paul T Chin
(74) *Attorney, Agent, or Firm*—Harris Zimmerman; Howard Cohen

(57) ABSTRACT

A method and apparatus for picking up dog waste has a container and plurality of claw elements moveable from a first position entirely within the container and a second position outside the container and spaced apart. In retrieving dog waste, the claws may be retracted radially to underlie such waste, and then be axially raised into the container.

8 Claims, 3 Drawing Sheets

METHOD AND APPARATUS FOR PICKING UP PET EXCREMENT FROM THE GROUND

CROSS-REFERENCE TO RELATED APPLICATIONS

Not applicable.

FEDERALLY FUNDED RESEARCH

Not applicable.

SEQUENCE LISTING, ETC. ON CD

Not applicable.

BACKGROUND OF THE INVENTION

1. Field of the Invention

This invention generally relates to devices for picking up solid material from the ground. More particularly, the invention relates to devices for picking up dog waste or excrement, encapsulating the same in a wrapper, and placing and storing the same in a compact container which can be easily carried by a dog walker, for subsequent dumping into a suitable receptacle or trash container.

2. Description of Related Art

In many locations throughout the world, a dog owner is responsible for physically picking up fecal matter excreted by the dog when the latter is out for walking or other purpose. It is common practice for a dog owner to carry one or more plastic bags when walking the dog. When the dog defecates, a plastic bag is placed with its open end down over the fecal matter, the owner manually places the open bag end over such matter, uses the bag as a barrier between his hand and the matter, manually urges the matter into the bag, and then inverts the bag and ties or otherwise secures the open bag end. This is not a pleasant experience, nor is the further task of carrying the bag to an acceptable receptacle for disposal.

A number of patents have been granted on devices which have been created in an attempt to solve the problems associated with the practice above described. Many of the devices heretofore created include a hand-held fecal matter retriever in which a claw-like member is movable from an open position overlying and generally encompassing the fecal matter to a closed position in which the distal portions of the claws attempt to move under the fecal matter so as to enclose such matter, and permit the same to be removed from the ground. Such claw structures have been developed for use with or without plastic bags or other pieces of moisture proof paper or the like to encapsulate the fecal matter.

Such prior art devices have not achieved their contemplated acceptance for a number of reasons. By way of example, some of these devices are quite complicated, and accordingly are too expensive. Others do not operate efficiently or are difficult to use or control. Some of these devices do not properly pick up the matter, contain it in a piece of plastic or the like providing an enclosed package, and then keep the package in a closed compartment until the package can be easily deposited in a suitable receptacle for ultimate disposal.

BRIEF SUMMARY OF THE INVENTION

The present invention involves a relatively simple claw-like mechanism normally positioned in a container. The entire device is intended to be easily carried in one hand. After a dog has excreted fecal matter on the ground, the user can open the container, place a sheet of paper, such as plastic wrap, over the matter, and then manually cause the claw member to extend downwardly and in an open position. Subsequent action causes the claws to uniformly move inwardly and result in the distal portions of the claws to engage the paper wrap. As the claws further close, the paper is forced between the ground and the fecal matter, the latter then being generally encapsulated by the paper or plastic wrap to provide a package. The closed claws or jaws may then be raised into the container, a lid member closing the open end thereof, putting the package out of sight. When a suitable disposal bin is found, the package containing the fecal material can be easily deposited in the same.

As a result of the foregoing features, the device of the present invention has a number of advantages and objects, including, without limitation, a construction which requires a minimal force to cause the claw or jaw members to uniformly close around the dog excrement, a device in which the wrapped excrement may be readily held in a container constituting a part of the apparatus; a claw arrangement which will not result in compressing the excrement, and instead leaving the same in its relatively solid state without forcing liquid from the same; in addition to its simple construction and ease of operation.

DESCRIPTION OF THE PREFERRED EMBODIMENTS

Figure 1:
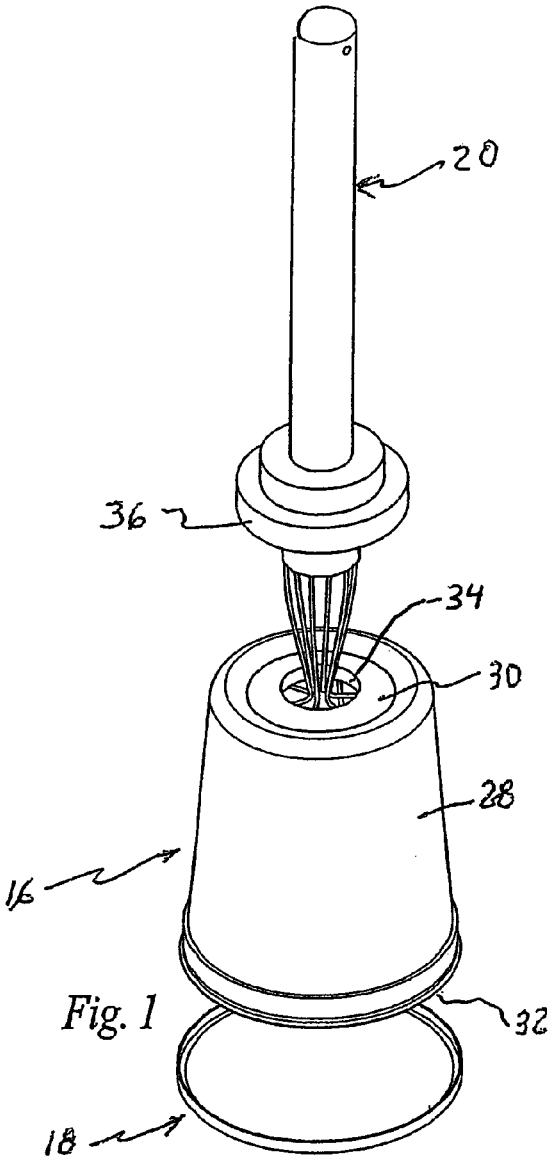
FIG. 1 is a perspective view looking down on the device in its inoperative condition, with the cover or closure member in close proximity to its associated container.
Figure 2:
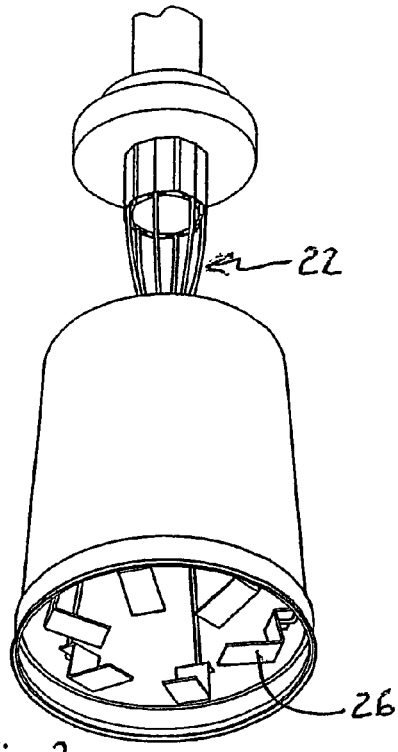
FIG. 2 is a perspective view looking upwardly into the container with the parts remaining in their stored inoperative container.
Figure 3:
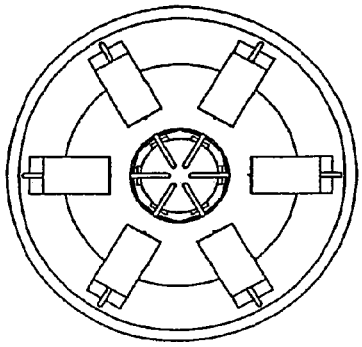
FIG. 3 is a bottom view of the device of FIG. 2.
Figure 4:
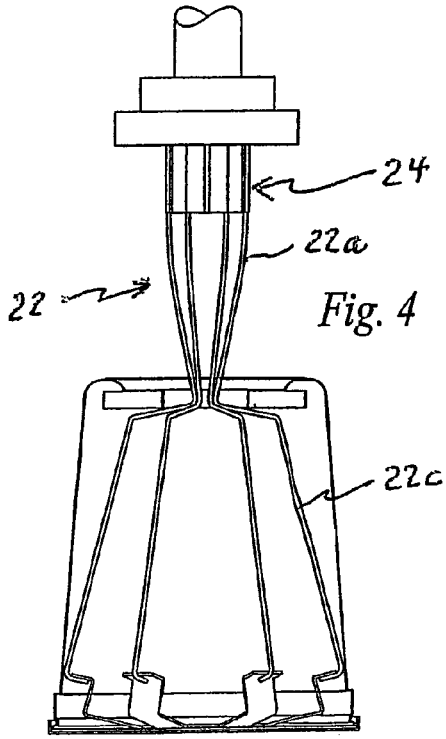
FIG. 4 is a side elevational view, mostly in cross-section of the device of FIG. 2.
Figure 5:
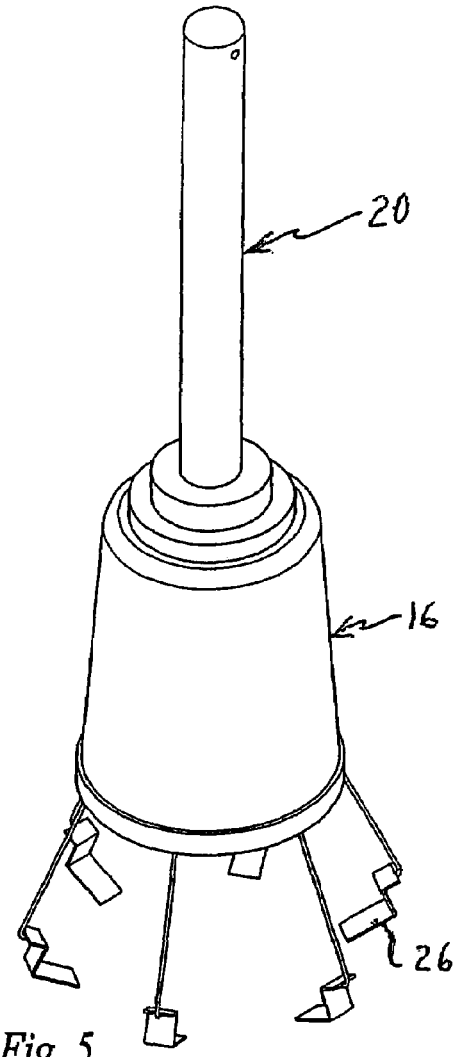
FIG. 5 us a perspective view similar to FIG. 1, and showing the claws in their first open position after being exited from the container.
Figure 6:
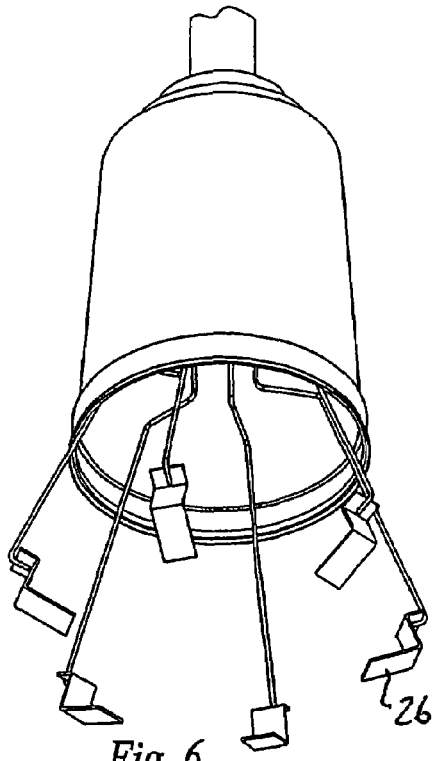
FIG. 6 is a bottom perspective view of the parts shown in FIG. 5.
Figure 7:
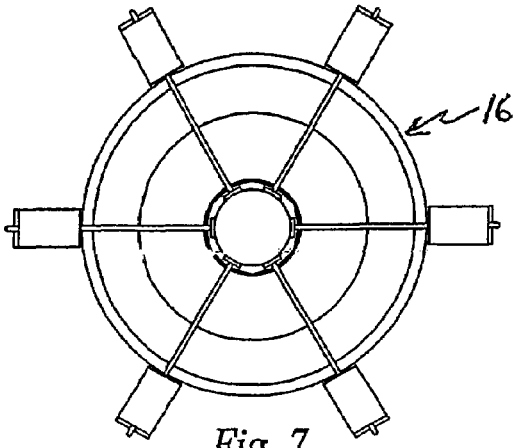
FIG. 7 is a bottom view.

In broad general terms, the apparatus of the present invention includes a container 16, a cover 18 for selectively opening and closing the container, a handle 20 for carrying the device, a plurality of rod-like claw elements 22 attached at their proximal ends to a claw supporting member 24 attached to handle 20, and attached to the distal ends of elements 22 are scoop-like projections 26 whose design and functions will be later described when the operation of the apparatus is discussed.

As shown in the drawings, container 16 comprises a generally cylindrical housing having side wall 28 with a top wall 30 and an open bottom 32. In normal use, the device will be carried and used in the spatial orientation illustrated in the drawings. Accordingly, the use of the terms "side", "top", and "bottom" are only used in reference to the operative positions of the parts of the apparatus. Container 16 is illustrated generally cylindrical, with an axis extending generally vertically. The diameter of the circular open bottom 32 is preferably slightly larger than the diameter of the closed end wall 30, thereby providing the container with a slightly tapered frustoconical cross-sectional elevational configuration.

Claw supporting member 24 is shown as a generally cylindrical plug adapted to move into and out of a cylindrical opening 34 in end wall 30. The upper end of the plug member 24 is formed integrally with or connected to handle 20 which may simply comprise a cylindrical shaft extending axially upwardly from the top 30 of the container. Any suitable stop member may be provided to prevent the claw supporting member 24 and its associated handle 20 from passing completely through opening 34 and through the open bottom 32 of the container. As here shown, the stop member comprises a radial flange 36 provided at the upper end of the plug member 24, having a diameter larger than the opening 34 in wall 30.

To continue with the description of the details of construction, it should be noted that extending generally axially downwardly from the periphery of plug member 24 are a plurality of claw elements 22 peripherally placed substantially equally around said member. Each such element comprises a longitudinally extending rod with spring-like characteristics. These elements can be deformed or bent into a desired configuration or shape, minimal forcing be applied to change the original shape, and upon release of the force, return to their original shape.

Figure 8:
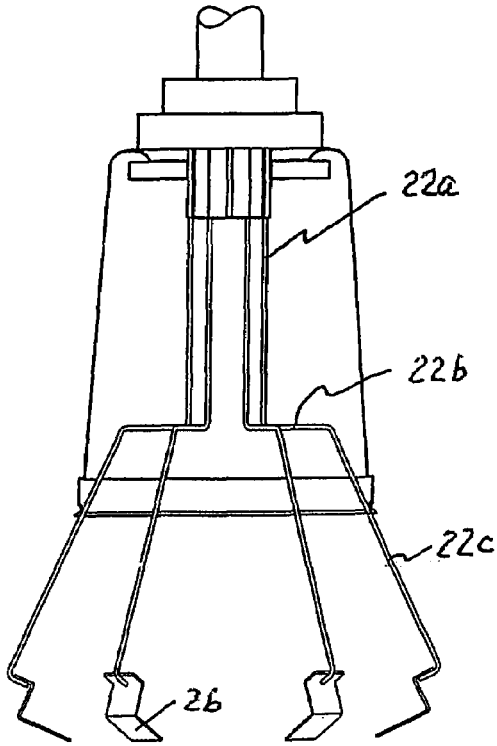
FIG. 8 is a side elevational view, mostly in cross-section shown in FIGS. 5, 6, and 7.

In the context of this invention, each element 22 has a straight proximal portion 22*a* extending axially downwardly from member 24 in parallel relationship to each other and to the axis of said housing or container 16 as illustrated in their normal position shown in FIG. 8. A medial portion 22*b* of each element extends radially outwardly from the lower end of portion 22*a*, and the distal end of portion 22*b* continues with a generally axially extending distal portion 22*c* flaring radially outwardly at an angle of about 30° from the axis of its proximal portion 22*a*. The lower extremity of portion 22*c* terminates with a radially inwardly projections 26.

The operation and function of this apparatus may now be discussed. FIGS. 1 to 4 illustrate the position of the parts in their inoperative stored condition, in which the dog owner would normally carry the device. This position is obtained by the user pushing downwardly on the container 16, axially away from handle 20, until the medial portions 22*b* of the claw members engage the inner surface of end wall 30 and prevent further axial separation of the parts. At this time, projections 26, and the distal portions 22*c* of elements 22 will be confined within the housing defined by the container chamber. It should also be explained that the ends of the element portions 22*c* are exerting a radial outward force against the container side wall, because during the axial separation of the handle and the container, the side walls of the container are urging the flexible distal portions radially inwardly.

A better understanding of the above described operation should be made clearer with reference to FIGS. 5 through 8. In these views, the container is pulled upwardly relative to the handle, and accordingly, the distal portions of the claw elements with their scoop-like projections flex radially outwardly from the container axis.

Referring back to FIGS. 1 through 4, it will be noted that the proximal positions of the rod elements 22 are exposed between the lower end of the handle 20 and the top wall of the container. This is primarily for ease of illustration and operation, since these portions can be readily enclosed in a sheath or other protective or ornamental covering, if desired.

Figure 9:
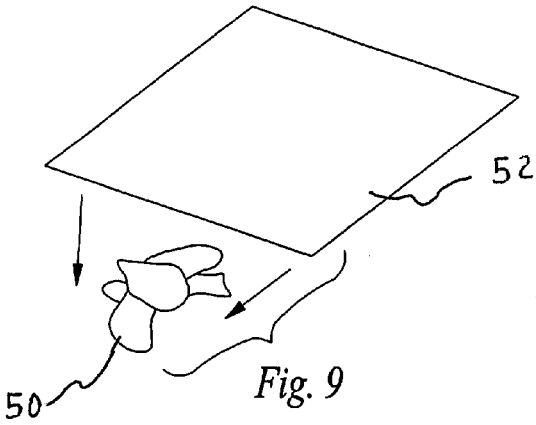
FIG. 9 is a perspective view of a sheet of paper or plastic about to be placed over a pile of excrement.
Figure 10:
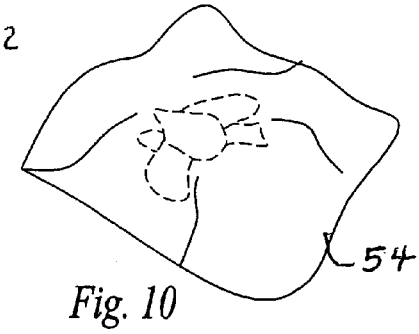
FIG. 10 is a view showing the sheet wrapped around the excrement.
Figure 11:
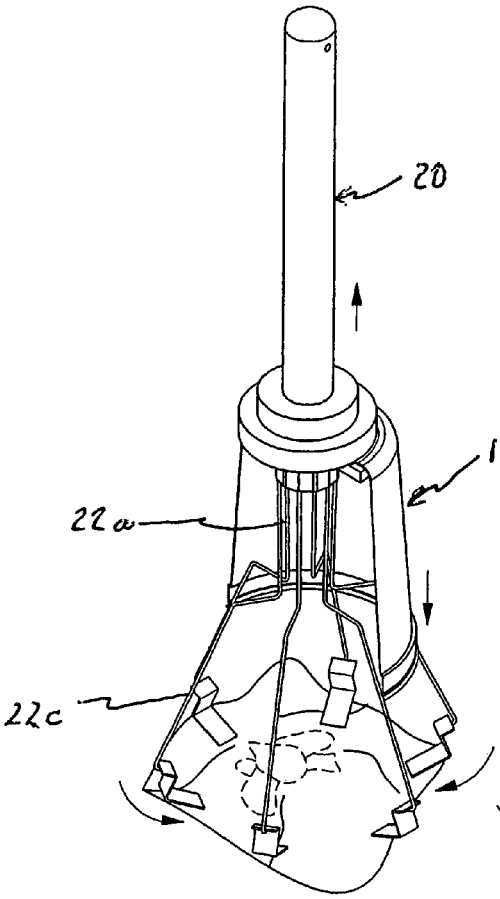
FIG. 11 is a perspective view, partly in section, illustrating the position of the parts as the claws commence closing around the excrement material.
Figure 12:
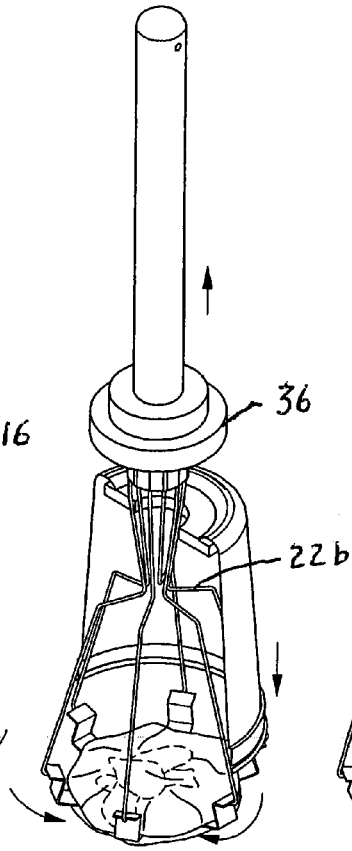
FIG. 12 is a perspective view, partly in section, illustrating the position of the parts just prior to complete closing of the claws.
Figure 13:
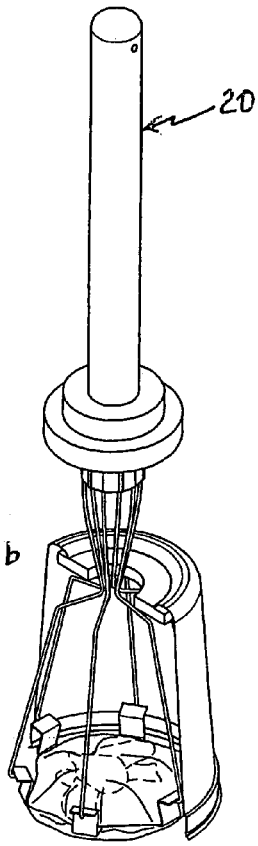
FIG. 13 is a perspective view, partly in section, illustrating the final closed position of the claws.

With reference to the utility of this invention, FIG. 9 diagrammatically represents dog excrement 50 on the ground. As soon as this excretion has been deposited on the ground, the user may place a piece of paper 52, such as plastic wrap or other moisture impervious material, over the material. Cover 18 is removed from the open end of the container as suggested in FIG. 1. The handle is then pushed downwardly towards the container, causing the claw elements 12 to extend from the lower end of the container as shown in FIGS. 5 through 8. The device is then positioned over the excrement with projections 26 placed on the paper 52 generally surrounding the underlying excrement as shown in FIG. 11. By pushing down on the container, the claw elements will be axially retracted with their projections 26 moved radially inwardly, thus bringing the paper sheet under the excrement and forming the package 54 shown in FIG. 10. The package is raised upwardly into the container and indicated in FIG. 11 through 13.

Cover 18 may then be placed on the container and the package will be hidden from view, until the owner locates a suitable disposal container, at which time, the cover is removed, and the package discharged by holding the container in one hand and pushing down on the handle with the other hand, causing the claws to be lowered, open, and release the package.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

The invention claimed is:

1. Apparatus for picking up pet excrement from the ground comprising a longitudinally extending housing having a longitudinal axis, side walls, an open lower end, and an upper end wall having a central opening on said housing axis, a claw supporting member positioned on said axis nonually disposed outside of said housing spaced from said end wall and movable along said axis from and towards said end wall, a plurality of rod-like claw elements, each of said elements extending through said central opening and being secured at an upper proximal end portion to said claw supporting member for movement therewith, each of said elements further having a medial portion extending radially outwardly from the lower end of its associated proximal end portion and within said housing, said elements also having distal portions with spring-like characteristics extending away from said end wan and sloping radially outwardly to resiliently engage said housing adjacent said lower open end thereof, said medial portions connecting said proximal end portions and said distal portions, said rod elements being moveable along said axis upon relative movement of the housing and support member, the outer end of each of said distal portions having a generally flat scoop member generally normal to the axis of its respective distal portion and primarily directed inwardly towards the axis of said housing, and said housing being moveable along said axis relative to said rod support member and said rod elements between a first closed position wherein the ends of said distal portions and said scoops are positioned entirely within said housing and each of said scoops is disposed close to an adjacent scoop, and a second open position wherein said ends of said distal portions and said scoops are positioned below and outside of said lower open end of said housing and spaced further from said axis than when said ends of said distal portions and said scoops are in said first position.

2. Apparatus as set forth in claim 1, including a cover releasably attached to said lower end of said housing when said rod support member and said rod elements are in said first position.

3. Apparatus as set forth in claim 1, in which said scoop members are spaced from each other when said scoops are in said second position and in which said scoops are positioned substantially immediately adjacent each other when in said first position.

4. Apparatus as set forth in claim 1, in which said housing is offrusto-conical configuration with said end wall having a smaller diameter that said open lower end of said housing.

5. Apparatus as set forth in claim 1, including a manually engagable handle extending axially outwardly from said end wall and attached to said claw supporting member whereby said handle, said claw supporting member, and said claw elements are secured to each other and move in unison relative to said housing along said housing axis.

6. Apparatus as set forth in claim 1, including stop means secured to said handle, said stop means comprising a radial flange having a diameter larger than said opening in said end wall thereby limiting the movement of said scoop members in said second position.

7. Apparatus as set forth in claim 1, in which said side walls of said housing normally urge said scoop members to move inwardly towards said axis when disposed within said housing and permit said scoop members to expand radially outwardly upon clearing the lower open end of said housing.

8. Apparatus as set forth in claim 1, including a manually engageable handle extending axially outwardly from said end wall of said housing and connected to said claw supporting member for assisting the user in providing relative axial movement between said housing and said claw members.

* * * * *